US006983864B1

(12) United States Patent
Cagle

(10) Patent No.: US 6,983,864 B1
(45) Date of Patent: Jan. 10, 2006

(54) FLUID DISPENSER ASSEMBLY

(75) Inventor: Ronald C. Cagle, Ventura, CA (US)

(73) Assignee: Harbor Dental Bleaching Group, Inc., Santa Barbara, CA (US)

( * ) Notice: Subject to any disclaimer, the term of this patent is extended or adjusted under 35 U.S.C. 154(b) by 106 days.

(21) Appl. No.: 10/606,013

(22) Filed: Jun. 24, 2003

(51) Int. Cl.
*B67D 5/60* (2006.01)

(52) U.S. Cl. ..... 222/131; 222/153.1; 222/321.9; 222/325; 222/385

(58) Field of Classification Search ..... 222/131, 222/153.1, 175, 183, 320–321.9, 325, 378, 222/383.1, 385
See application file for complete search history.

(56) References Cited

U.S. PATENT DOCUMENTS 4,620,646 A * 11/1986 Crapser ..... 222/153.11
4,944,429 A * 7/1990 Bishop et al. ..... 222/153.13
5,016,781 A * 5/1991 Ten Wolde ..... 222/162
5,215,227 A * 6/1993 Farner ..... 222/175
5,683,012 A 11/1997 Villaveces
5,927,548 A 7/1999 Villaveces
6,092,694 A * 7/2000 Sadow ..... 222/78
6,305,580 B1 * 10/2001 Chen ..... 222/162
6,412,659 B1 * 7/2002 Kneer ..... 222/82

FOREIGN PATENT DOCUMENTS

WO WO 99/16552 * 4/1999

* cited by examiner

*Primary Examiner*—Frederick C. Nicolas
(74) *Attorney, Agent, or Firm*—Jack C. Munro

(57) ABSTRACT

A fluid dispenser 10 with a replaceable receptacle 11 containing fluid 47 positioned within a housing 12. An inlet tube 42 and an outlet tube 43 are connected to a pump assembly 15 for drawing fluid from the receptacle and moving the fluid through a nozzle 80 having fluid discharge aperture 41. The nozzle is secured to a hand actuatable cover 13 which is depressable to operate the pump. The pump is mounted upon a retainer 14 which is connectable to the housing. When the receptacle becomes empty, the retainer may be disengaged from the housing, and the retainer and pump are then lifted away as one unit from the housing. The empty receptacle may then be replaced with a full one, and in reverse order, the dispenser may be reassembled.

12 Claims, 5 Drawing Sheets

FLUID DISPENSER ASSEMBLY

BACKGROUND OF THE INVENTION

1. Field of the Invention

The present invention relates generally to manual spray-pump fluid dispensers. More particularly, the present invention relates to a pump-type fluid dispenser that provides for easy replacement of fluid supply receptacles which also have the capability of being operable with the same hand that receives the dispensed fluid.

2. Description of the Related Art

Pump type dispensers for dispensing a fluid have become a common staple of every day life. However, a variety of inconveniences attend the use of hand-held or small sized spray pumps and fluid dispensers. Some fluid dispensers are operated from a table top, and others are held in a hand during use. The preference for usage is usually an ergonomic one, and depends largely on the shape of the fluid container and the shape and location of the spray actuator. Creams and gels, such as hand cream, are often in a container with a pump actuator that includes a horizontal spout with the tip of the spout pointing down. Although such designs can be used for any viscosity fluid, this ergonomic design is commonly used for more viscous fluids being expelled into the hand, such as hand creams or hair gels. These pump bottles are typically operated while the container is resting on a bathroom counter or dresser top. In such a case, the user might pump the pump head with one hand, and extend the other hand underneath the pump spout to receive the dispensed product.

When using a hand sized pump-type fluid dispenser resting on a surface, the force imparted on the head of the dispenser can tip over if it is not steadied or braced. Similarly, such force can rotate a spray head resulting in a fluid discharge in a wrong direction. Either of these events requires that the sprayer or pump be stabilized, and the spray-head steadied or aimed. In response to this, it is not uncommon for a user to steady a pump bottle or spray bottle with one hand while pumping or spraying it with the other. In those circumstances wherein a product is being applied to the hand, the likelihood that two hands are needed is even greater.

While the above can be suitable for some endeavors, it is ill suited for other endeavors. For example, the work of physicians, dentists and automotive mechanics commonly requires the use of hand held tools and, therefore, demands that one, or both hands remain substantially free to work. Some occupations, however, involve work in an environment wherein a subject's hands become slippery or dirty while working. In such case, it would be preferable to regularly cleanse the hands and/or apply a tacky agent to maintain a better grip on a tool or instrument.

For example, physicians and dentists often use pump or spray-type germicides and disinfectants on their hands. But, it is time-consuming, burdensome and counterproductive to require the physician to hold a germicide sprayer with one unclean hand and squirt or spray germicide into the other. Then, hold the unclean sprayer with a clean hand and spray germicide into the other unclean hand. Moreover, physicians oftentimes need to move about from room to room in a hospital or clinic where traditional hand-pump dispensers may not be conveniently located.

The body-worn dispensers described in U.S. Pat. Nos. 5,683,012 and 5,927,548 overcome many of the above problems. However, the patented dispensers of the aforementioned patents do not set forth an interconnected pump, pump cover and integration structure that simplifies the exchange of fluid receptacles.

What is needed, therefore, is a fluid dispenser that can be conveniently refilled and reused. A further need exists for a dispenser that does not require a user to disassembly multiple parts for the purpose of exchanging a fluid receptacle or disposable cartridge. A need also exists for a dispenser that can easily be set-up to dispense multiple types of fluids. The need further exists for a spray or pump-type dispenser that requires only one hand to operate and receive fluid, thereby allowing the free hand to hold a tool or perform a task.

SUMMARY OF THE INVENTION

The present invention is directed to a fluid dispenser that is easily located, does not require a user to depart from his or her work station in order to use the spray-pump, and can reliably be operated with a single hand without tipping over the spray pump, twisting the spray head, or otherwise discharging the sprayer contents in a wrong direction. Additionally, the invention permits one hand of a user to remain free while dispensing and receiving the discharged product. Moreover, the invention provides for the interconnection of a pump means and fluid actuating parts that are easily disengagable as a unit from a dispenser housing.

The invention comprises an outer housing containing a fluid-filled receptacle that is removable from the housing. A pump assembly comprising a pump head that reciprocates within a pump body is used to move fluid out of the receptacle. The body is connected to an intake tube extending into the fluid. The pump body has an outlet tube in communication with a depressible nozzle having a fluid discharge aperture.

A cover is used to actuate the pump assembly. The cover is dome-shaped with a side opening in alignment with the discharge aperture. In an assembled state, the cover is attached to the nozzle so that when a down and then upward force is imparted to the cover, the nozzle, outlet tube and pump head will move down and up, causing fluid to be drawn from the receptacle into the pump body and then out through the outlet tube, nozzle and discharge aperture. The nozzle is oriented so that fluid discharged through the nozzle aperture will pass through the cover side opening.

The pump body is secured to a connector means which, in turn, releasably constrains the receptacle within the outer housing. The connector means also provides retention constraints for the movable cover. In this way, a fluid actuating unit is created comprising the cover, pump assembly and connector means which can be moved as a unit from the housing to provide ready access to the removable receptacle. This allows the receptacle to be refilled and replaced, or be discarded.

An attachment means may be used to couple the fluid dispenser to the body of a user. The attachment means may be any one or combination of a member selected from the group consisting of a clip, clasp, clamp, cord, chain, pin, lanyard, belt, magnet and velcro™.

The cover is ergonomically configured so the user can depress the cover using the heel of a hand while the palm of the same hand is in front of the side opening. In this arrangement, fluid being discharged from the side opening will be directed toward the user's palm. The type of fluids useful with the fluid dispenser of the present invention include germicide agents, antiseptics, anti-bacterial agents, disinfectants, sanitizers, moisturizers, skin care preparations, soaps, degreasers, cleansers and tackifying agents.

As used herein, the terms "solution" and "fluid" include gels, creams, pastes, foam, liquids, solid-liquid mixtures and mists which are known to be dispensed by various hand-sized pump and spray dispensers. Similarly, the terms "sprayer" and "spraying" and related terms are also used inclusively, and can refer herein to spraying, pumping, expelling or discharging any of the referenced fluid forms noted above.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
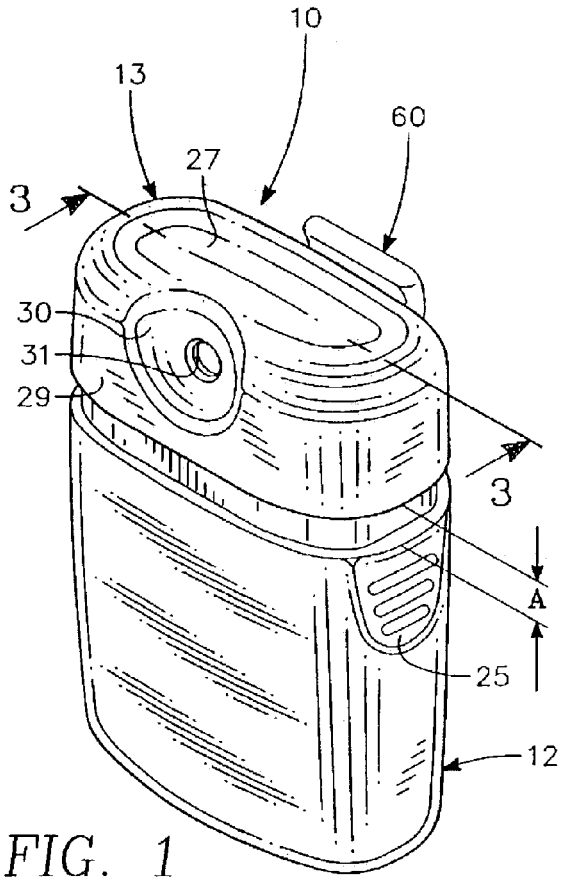
FIG. 1 is an isometric view of the overall fluid dispenser of the present invention.
Figure 3:
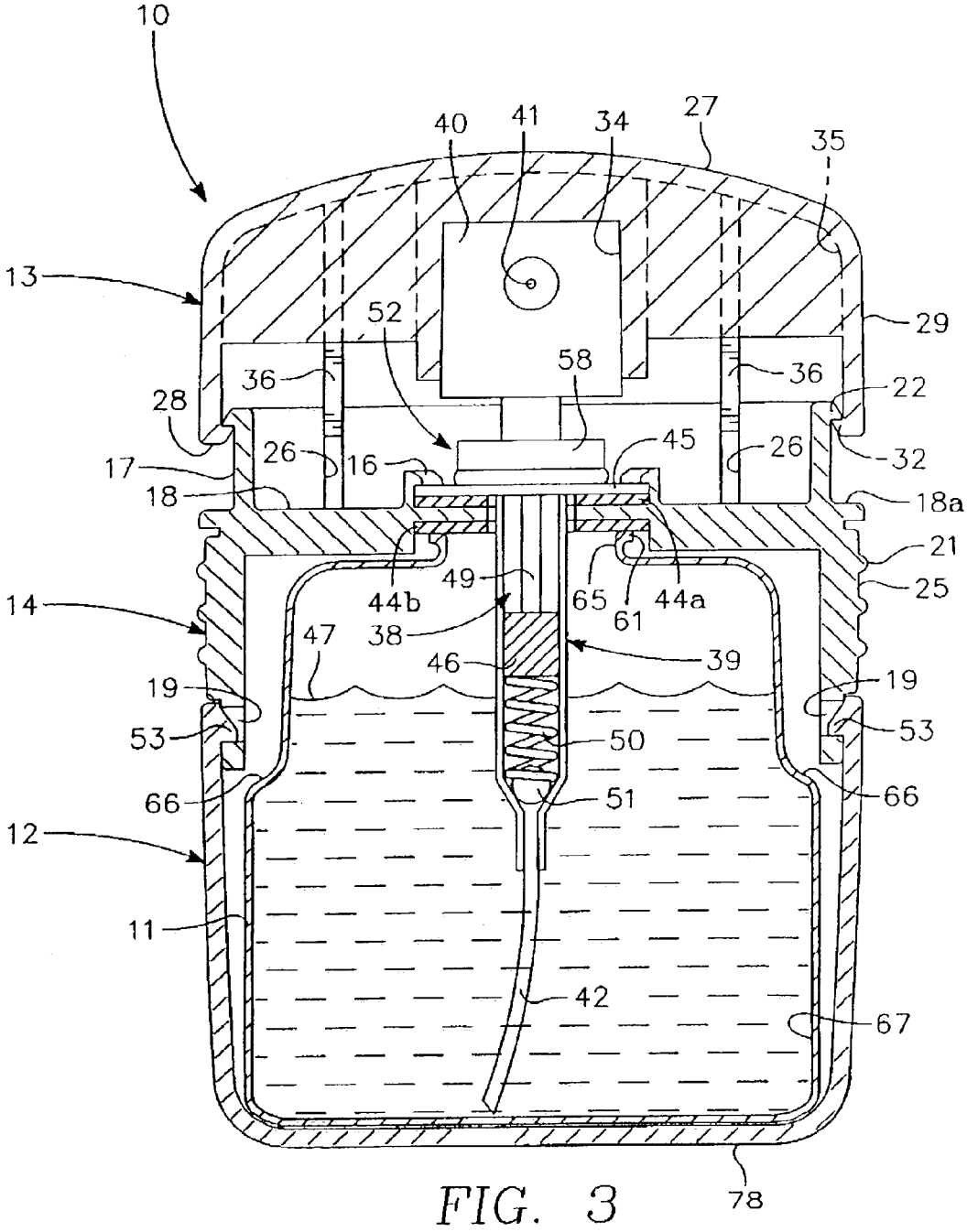
FIG. 3 is an enlarged cross-sectional view taken along lines 3—3 of FIG. 1.
Figure 7:
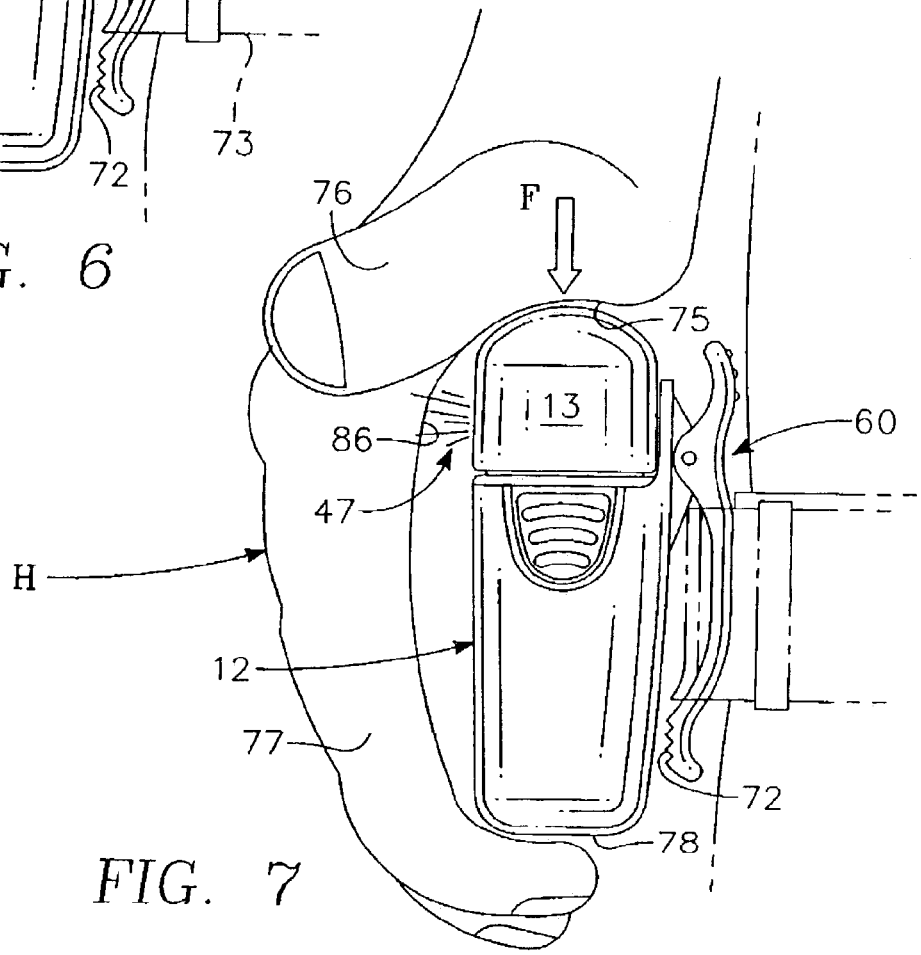
FIG. 7 illustrates a user dispensing a fluid from the attached dispenser shown in FIG. 6.

With attention to FIGS. 1, 3 and 7, the fluid dispenser of the present invention is shown generally by reference 10. The dispenser is configured to discharge a fluid 47 into the palm 86 of the actuating hand (H) of a user. The overall dispenser has a generally polygonal shape with a dome-shaped upper cover 13. The cover has a top surface 27 and an open interior 35. From the top surface 27 is a downwardly extending peripheral skirt 29. A front portion of the skirt is provided with a concave indentation 30 that includes a side opening 31. The skirt 29 terminates at bottom edge 28.

Extending inwardly from the bottom edge 28 of opposing sides of the skirt 29, are lip flanges 32. The lip flanges 32 are configured to engage corresponding shoulder flanges 22 of a retainer 14, in a manner to be hereinafter described.

Figure 4:
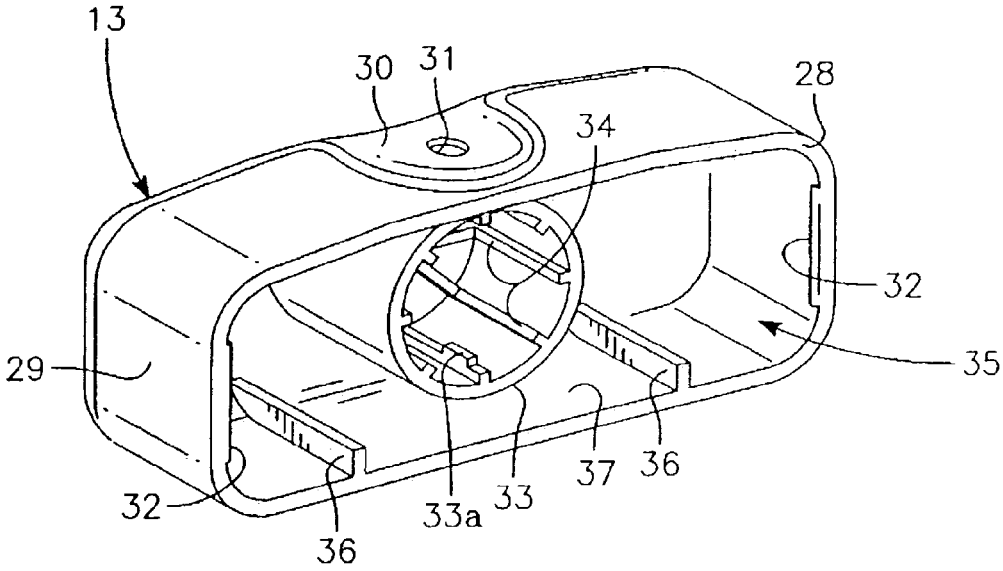
FIG. 4 is an enlarged isometric view of the interior of the cover shown in FIG. 1.

Extending downwardly from the top underside of cover 13 is a nozzle enclosure shown as connector part 33. The connector part 33 includes frictional engagement means for releasable securing nozzle 40 of pump assembly 15. Typically, the nozzle 40 has a cylindrical plug-like shape whereby the connector part 33 will have a corresponding tubular shape with an inner surface that frictionally interfits with respective outer surfaces of the nozzle 40. As best shown in FIG. 4, the inner walls of the connector part include spaced-apart vertical ribs 34 for frictionally effecting a secure, but releasable connection with the pump nozzle 40.

Figure 2:
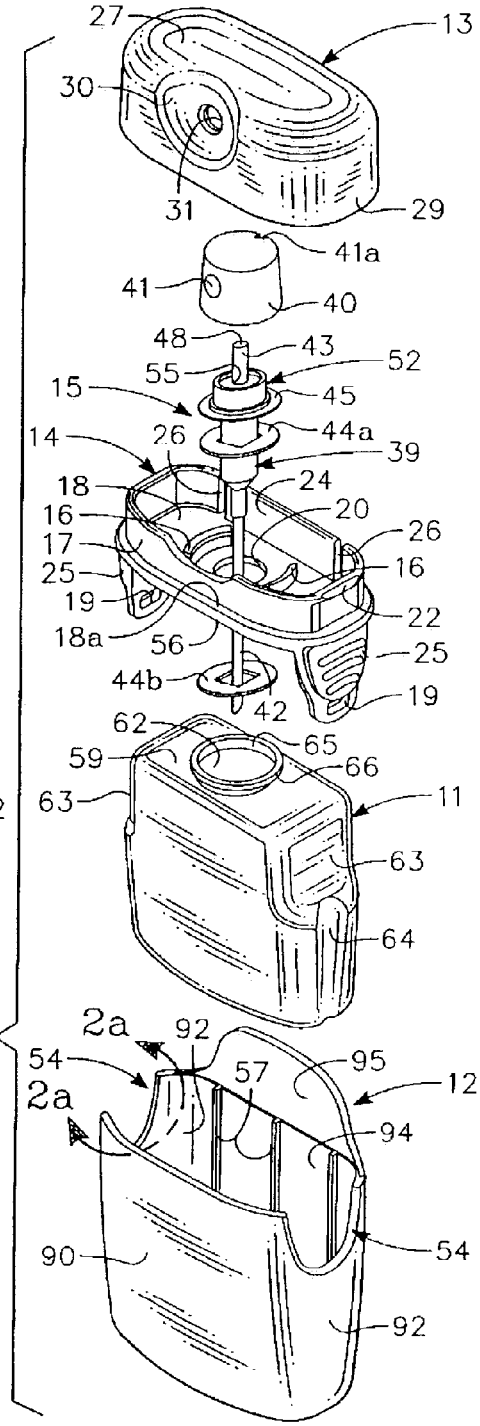
FIG. 2 is an exploded isometric view of the dispenser shown in FIG. 1.

As best shown in FIGS. 2 and 4, nozzle 40 includes a fluid discharge aperture 41 through which fluid passes upon operation of the pump assembly 15. To ensure proper alignment between the skirt side opening 31 and discharge aperture 41, the nozzle 40 may have an alignment means such as a key slot 41*a* that is engagable with a predetermined rib or key projection 33*a*.

A connector means, shown as retainer 14, functions to attach the cover 13 and pump assembly 15 to the housing 12 and to hold the receptacle 11 securely within the housing 12. Because embodiments are envisioned wherein the cover 13 may be coupled directly to the housing 12, or the receptacle 11, the particular structure and elements forming the retainer 14 are not intended to limit other applications of the present invention, and are exemplary only.

The retainer 14 comprises a platform 18 having an upwardly extending peripheral retainer wall 17. The retainer wall 17 is offset inwardly from the platform outer periphery to create an outer ledge 18*a*. On opposing upper side edges of the retainer wall 17 are the aforementioned shoulder flanges 22 forming an upper snap configuration for engagement with the cover lip flanges 32. As illustrated in FIG. 3, the shoulder flanges 22 and the lip flanges 32 have corresponding beveled surfaces that allow these structures to slide past each other, thereby facilitating a snap fit assembly. The distance A in FIG. 1 between a pair of facing arrows from ledge 18*a* and shoulder flange 22 defines the maximum reciprocation movement of cover 13.

A flex arm 25 extends downwardly from the underside of each opposing side of retainer bottom 18. Each flex arm 25 is constructed of a resilient material and may include finger ridges 21. At the lower end portion of each flex arm 25 is a connector element shown as retention opening 19.

As seen in FIG. 2, upper rear wall 24 of a retainer 14 is provided with two spaced-apart guide slots 26, 26. The guide slots 26, 26 are open at the upper rear wall top edge and extend vertically downward to platform 18. Each slot 26 is sized to engage a corresponding guide track 3, 36 that extends inwardly from skirt back wall 37 of cover 13. The above-described guide means function to ensure proper alignment and movement of cover 13 when it is moving up and down during operation of the dispenser.

Figure 8:
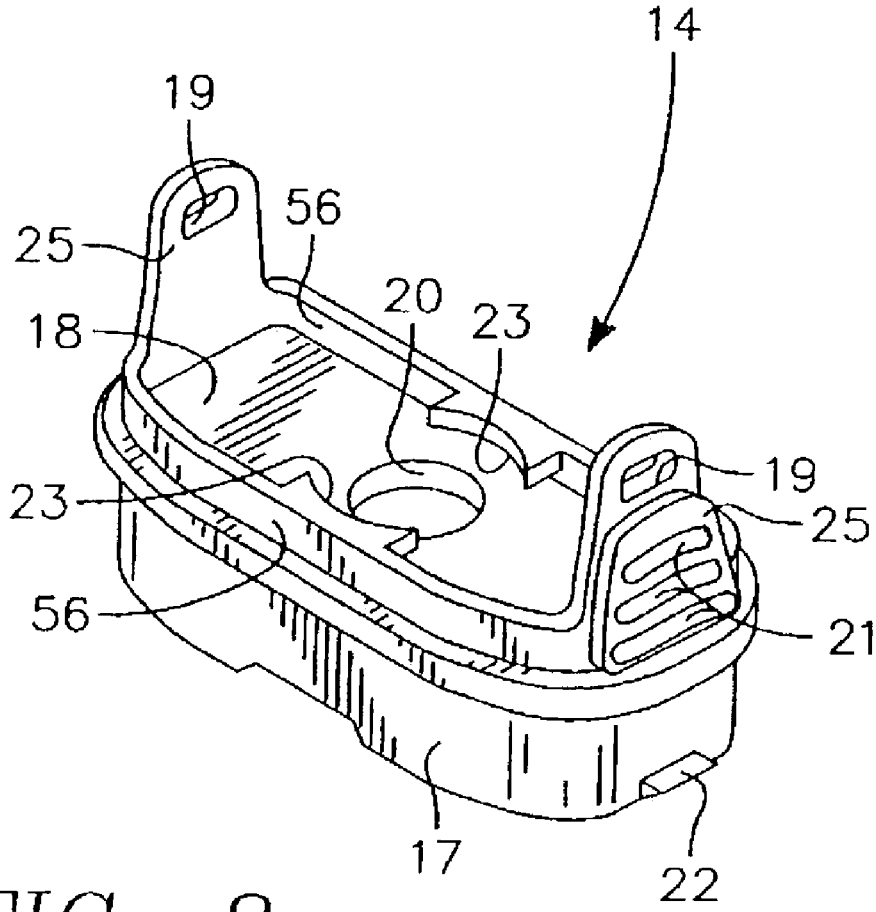
FIG. 8 is an isometric view of the underside of the retainer shown in FIG. 2.

In the middle portion of platform 18 is a connector opening 20. Extending upwardly from the platform upper surface on opposing sides of the connector opening 20 are detents 16, 16. As shown in FIG. 8, extending downwardly from the platform underside on the front and rear sides of the connector opening 20 are washer tabs 23, 23. The washer tabs 23, 23 extend inwardly from opposing lower washer 33*b* in a manner to be described. The above detents and tabs function to secure pump assembly 15 to the retainer connector opening 20.

The pump assembly 15 includes a pump means comprising a pump body 39 that encloses a fluid flow chamber 38 within which is a reciprocating pump head 46. The pump head is biased by spring means shown as compression spring 50 into an upper inoperative position. The chamber includes a check valve 51 that permits fluid to be drawn from a fluid source 47 through intake tube 42 and into the chamber 38 during upward movement of the pump head 46. Upon downward movement of the pump head 46, against the force of spring 50, the check valve 51 prevents fluid from flowing back into the fluid source 47, whereby fluid in the chamber will be expelled through one-way passageways in the pump head 46, then through outlet tube 43 and into nozzle flow channels (not shown) in communication with nozzle discharge aperture 41.

Fixed to the upper portion of pump body 39 is a pump engagement means shown as crown structure 52. The crown structure 52 has a center body 58 with an outwardly extending brim 45. An axial bore 55 extends longitudinally through the center body. Pump outlet tube 43 reciprocates within the bore 55 and functions as a rigid stem mounting element for nozzle 40. The outer open end 48 of the outlet tube is in fluid communication with the nozzle flow channels to permit fluid flow from outlet tube 43 to nozzle discharge aperture 41.

The outlet tube 43 is also structurally fixed to pump head shaft 49. Therefore, when nozzle 40 is depressed via cover 13, outlet tube 43, shaft 49 and pump head 46 will move down simultaneously. When downward force on cover 13 is removed, compression spring 50 will provide an upward force and reverse movement of the aforementioned parts. Alternatively, the pump spring means may include, or comprise, a tension spring interconnecting the crown structure 52 and pump head 46. The tension spring would also provide an upward force, and could supplement compression spring 50.

The brim 45 has a diameter that corresponds to the space between opposing detents 16, 16. This relationship allows the brim 45 to snap into the detents 16, 16 and connect the overall pump assembly 15 to the retainer 14. Preferably, resilient sealing means, shown as upper washer 44*a* and lower washer 44*b*, are used to effect a seal over and under center opening 20. The upper washer 44*a* fits between the upper annular margins of platform 18 that surround connector opening 20 and the underside of brim 45. The outer periphery of lower washer 44*b* is held between the underside annular margins of platform 18 that surround center opening 20 and the undercut spaces of tabs 23, 23. When the dispenser is assembled, outlet rim 66 of receptacle 11 is impressed against the lower washer 44*b*.

Alternative pump assembly engagement means could be used. For example, the crown structure 52 or the pump body 39 could be provided with external threads which would engage corresponding inner threads formed in connector opening 20. Further, the crown structure could be permanently fused, bonded or adhered to platform 18.

Figure 2A:
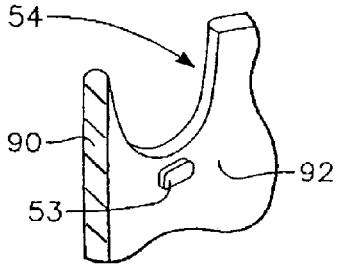
FIG. 2*a* is an isometric view of a portion of the housing used within the fluid dispenser of this invention taken along line 2*a*—2*a* of FIG. 2.

The receptacle 11 contains the source of fluid 47 being discharged. It is a hollow polygonal shaped structure with a top wall 59 from which extends an upraised neck 65. The neck 65 terminates at an outwardly extending outlet rim 66 that defines receptacle top opening 62. Each lateral side of the top wall 59 merges downwardly into a recessed shoulder area 63, 63 to accommodate respective flex arms 25, 25 extending downwardly from the retainer platform 18. Each lateral side of the receptacle 11 also includes a vertical groove 64 that extends from the base of each shoulder 63, 63 to the receptacle bottom. The groove 64 is sized to permit passage of respective retention parts shown as tabs 53, 53 that project inwardly from respective inside surfaces of the housing sidewalls 92, 92. See FIG. 2*a*.

Housing 12 provides a base support for the overall fluid dispenser 10. It has a polygonal cross-section that is larger than the cross-section of receptacle 11. It has a closed bottom 78 from which extend front wall 90, opposing sidewalls 92, 92 and back wall 94. The walls 92 and 94 define an open top and interior having a configuration that permits insertion of the receptacle 11. Each sidewall 92 and 94 includes an inverted arch opening 54, 54 to accommodate a respective flex arm 25 when the receptacle 11 is nested within the housing interior.

To facilitate insertion and removal of the receptacle 11 into the housing, the interior surface of back wall 94 may include multiple slide rails 57. The rails 57 further provide for air passage and prevent a vacuum lock from occurring when removing the receptacle 11 from the housing. The back wall may also include an optional upper extension 95 to facilitate connection to an external attachment means.

Figure 5:
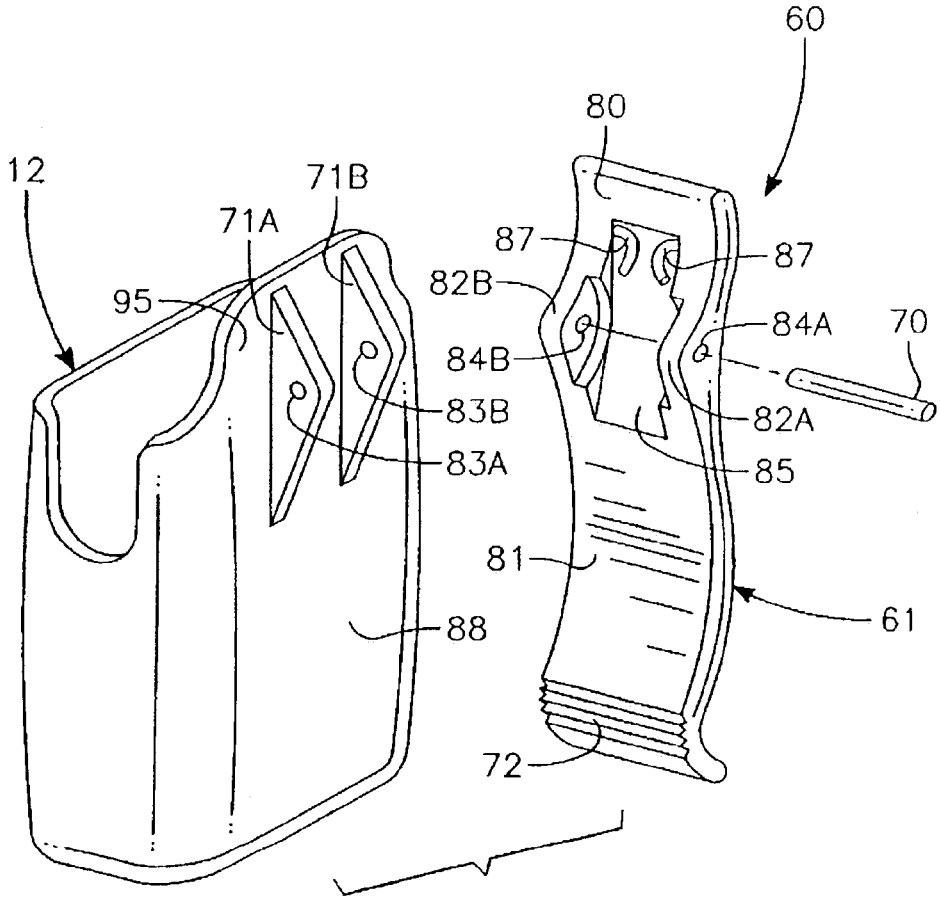
FIG. 5 is an isometric view of the back of the housing shown in FIG. 1 with an attachment clip broken away from the housing.
Figure 6:
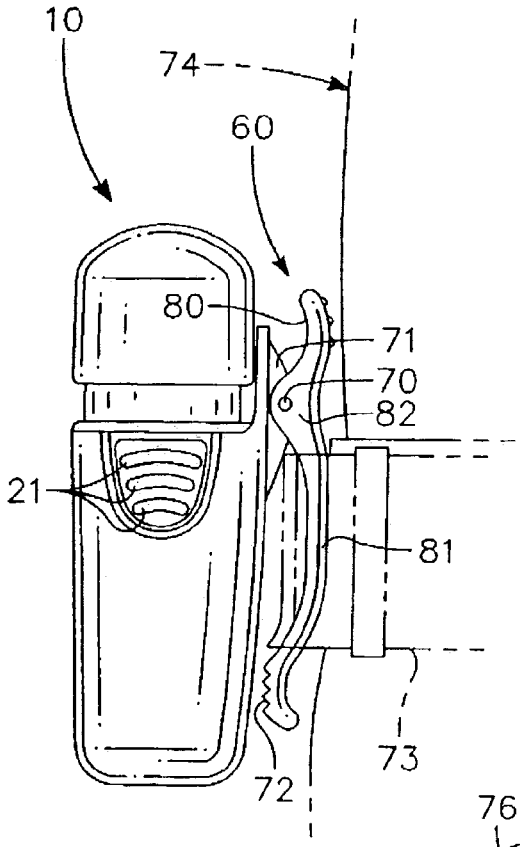
FIG. 6 is a right-side elevational view of the dispenser shown in FIG. 1 attached to a user's belt shown in phantom.

The attachment means shown in FIGS. 5–7 is a spring-biased clip assembly 60 that includes a clip body 61. With particular reference to FIG. 5, the clip body 61 is rotated to reveal the interior structure of the clip assembly 60. Two fulcrums 71A, B are affixed to the rear exterior surface of the back wall upper extension 95. Each fulcrum 71A, B is formed from a solid raised member having a fulcrum hole 83A, B which is sufficient to accommodate insertion of a pivot pin 70. The clip body 61 is formed from a single continuous solid member having a shorter arched upper wing 80 and a longer arched lower wing 81. The wings merge to form connecting flanges 82A, B formed on the clip body inner surface. Each connecting flange has a pivot hole 84A, 84B large enough to accommodate the pivot pin 70.

The clip body 61 is oriented so that the connecting flanges 82A, 82B straddle the fulcrums 71A, 71B, and the pivot holes 84A, 84B are aligned with the fulcrum holes 83A, 83B. Pivot pin 70 is sized to fit snugly within the pivot holes 84A, 84B, and is long enough to extend through both pivot holes simultaneously. The pivot pin 70 is inserted through the holes 83A, B and 84A, B and fixed in place, thereby attaching the clip body 61 to the housing back wall upper extension 95.

A clip spring 87, connected to the inside of the clip body 61, urges the upper wing 80 of the clip assembly 60 away from the outer rear surface 88 of back wall 94, thereby urging the lower wing 81 to forcibly rotate toward the outer rear surface 88. A retention recess 85 can be formed within the inner surface between the connecting flanges 82A, B to house the clip spring used to exert continual tension on the clip body 61. The inner surface at the end of the lower wing 81 may have a textured clip terminus 72 which helps to prevent the clip assembly 60 from sliding off a belt or article of clothing.

It will be appreciated that the clip assembly 60 described above is exemplary only and is not intended to limit the numerous types of user attachment means that may be used with the invention. For example, it is not necessary to have the dispenser confined to a stationary position on a user's body. The dispenser may be connected to one's body by a cord, chain, rope, lanyard, clip with a retractable line, band and string.

Generally referring to the orientation of elements in FIG. 2, the receptacle is filled with a desired fluid 47. The receptacle 11 is then lowered into the interior of housing 12. During downward movement, side grooves 64, 64 pass along housing retention tabs 53, 53.

The free end of intake tube 42 and pump body 39 are passed through the upper washer 44A, and then through the connector opening 20 in the retainer platform 18, with the insertion continuing until brim 45 squeezes the washer 44A against the top of the platform 18. This action will then snap brim 45 into detents 16, 16, thereby securing the pump assembly 15 to platform 18 of retainer 14.

After the pump assembly 15 has been coupled to the retainer 14, lower washer 44B can be positioned around pump body 39 and pressed up against the underside of retainer platform 18 until it is engaged with washer tabs 23, 23.

When the lower washer 44B is in place, the free end of intake tube 42 is lowered into receptacle top opening 62 until the washer 44B sealingly engages outlet rim 66 of the receptacle 11. During insertion, the flex arms 25, 25 are guided down the respective arch openings 54, 54 until retention openings 19, 19 snap over retention tabs 53, 53.

The height of receptacle 11 is selected such that when the retainer 14 and the housing 12 are joined by the cooperating retention means described above, tabs 53, 53 will be engaged with retention openings 19, 19. Lower washer 44B will also be effectively compressed against receptacle rim 66 to effect a fluid-tight seal and prevent spillage or leaking of the fluid 47.

The cover 13 may then be lowered onto the retainer 14. During lowering, the cover 13 is being guided by sliding engagement of cover guide tracks 36, 36 with retainer guide slots 26, 26. If necessary, nozzle 40 may be rotated to align discharge aperture 41 with cover side opening 31. As the cover 13 is moved downward onto the retainer 14, the cover lip flanges 32, 32 are aligned with, and engage retainer shoulder flanges 22, 22. In this way, the cover 13 is movably coupled to the retainer 14 in a snap fit. Alternative assembly embodiments envision a nozzle 40 being incorporated into the cover 13 in a factory process, whereby flow tube 43 may simply be inserted into the nozzle flow channels.

Generally referring to FIGS. 6 and 7, a user may first attach the fluid dispenser to a body worn garment. This is accomplished by depressing upper wing 80 of a clip body 61, thereby rotating lower wing 81 of the clip assembly 60 away from the outer rear surface 88 of back wall 94. Although the clip assembly 60 can be attached to a variety of locations, such as a pocket or the waste-band of trousers, according to the preferred embodiment, the clip assembly 60 will be advantageously attached to a standard belt 73 girding the waist of a user 74. To do this, the opened lower wing 81 of the clip is inserted behind the belt 73 and forced against upper wing 80 and then released. Spring 87 will then urge lower wing 81 toward the outer rear surface 88 of the housing 12, thereby holding the dispenser 10 against belt 73.

With particular reference to FIG. 7, to activate the dispenser and discharge a portion of flowable product onto a hand, the heel 75 of a user's actuating hand is placed onto cover 13. This position will direct a user's thumb 76 laterally and locate a users palm 86 adjacent cover side opening 31. Fingers 77 may then be partially curled beneath dispenser bottom 78. With the actuating hand in the above position, heel 75 may easily be squeezed downwardly against the cover 13. The cover 13 may move downwardly a maximum amount to a stop means. The stop means comprises the abutment between retainer outer ledge 18*a* and the bottom edge 28 of cover skirt 29. As explained previously, this action will result in the discharge of product fluid 47 into palm 86.

When fluid 47 in receptacle 11 is exhausted, flex arms 25, 25 are pressed inwardly, such as by placing fingers on ridges 21 and squeezing. This action disengages retention openings 19, 19 from retention tabs 53, 53 and allows the entire fluid actuating unit to be lifted away from the receptacle 11 and housing 10. The empty receptacle 11 may now be removed from the housing 10 and a fluid-filled receptacle may be inserted in its place.

Although the subject dispenser is particularly beneficial for agents designated for the hands, the discharge of other flowable products are envisioned within the scope of the present invention. For example, the dispenser 10 could be used to dispense oils, greases, paints, sealants, adhesives, sunscreen, medications, or general purpose agents into the hand of a subject 74, and subsequently rubbed onto other areas of the body, or onto other bodies, workpieces, tools, structures or instruments.

The foregoing description is directed to a spray or pump dispenser that is attached directly or indirectly to the body of a user, eliminating the need for the user to have a dispenser at each work station. This design further eliminates the need for the user to visually seek the dispenser, since it is attached to the body and travels with the user. Additionally, the motion to engage and operate the dispenser is minimal. Moreover, the dispenser is reusable whereby an empty receptacle is easily replaced with a filled receptacle.

Within the foregoing description, many specific details commonly known by those skilled in the art have not been recited so as to not needlessly obscure many of the essential features of the invention. In other instances, many specific details have been described in conjunction with the specific embodiments of the claimed invention. For example, the specific shape and form of many flanges, tabs, and securing members were recited for coupling the cover 13, retainer 14, pump assembly 15 and housing 12 around a receptacle 11. Those skilled in the art will understand that alternative joining structures, including but not limited to snaps, pins, threaded members, adhesives, cloth fasteners, wedges and clasps, can be incorporated with the claimed invention. On the contrary, it will be readily apparent to one skilled in the art that the claimed invention may cover alternative designs, modifications, and equivalents which may be practiced without the use or incorporation of these and many other specific details. Accordingly, the specific embodiments and details of the above disclosure should not be construed so as to limit the spirit and scope of the claims appended hereto.

I claim:

1. A fluid dispenser comprising:

a receptacle with an opening, said receptacle adapted to contain a fluid;

a retainer comprising a platform with a connector opening and opposing retainer side walls;

a pump assembly secured to said retainer comprising an intake tube and an outlet tube connected to a nozzle having fluid outlet aperture, said intake tube and said outlet tube being in communication with a pump means for transporting the fluid from said receptacle to said outlet aperture;

a cover connected to said nozzle, said cover, nozzle and outlet tube being movable to cause actuation of said pump means; and said cover has a side opening in communication with said outlet aperture.

2. A fluid dispenser comprising:

a receptacle with an opening, said receptacle adapted to contain a fluid;

a retainer comprising a platform with a connector opening and opposing retainer side walls;

a pump assembly secured to said retainer comprising an intake tube and an outlet tube connected to a nozzle having fluid outlet aperture, said intake tube and said outlet tube being in communication with a pump means for transporting the fluid from said receptacle to said outlet aperture;

a cover connected to said nozzle, said cover, nozzle and outlet tube being movable to cause actuation of said pump means;

said pump means includes a biasing means to maintain said cover, nozzle and outlet tube in an uppermost inactive position;

said cover and said retainer sidewalls include stop means for limiting upper movement of said cover to said uppermost inactive position;

said retainer platform has an outer periphery and at least said retainer sidewalls are offset inwardly from said periphery to define an outer platform ledge; and said cover including a skirt that extends downwardly a predetermined distance to a lower edge which contacts said platform ledge when said cover is in a lowermost position.

3. A fluid dispenser comprising:

a receptacle with an opening, said receptacle adapted to contain a fluid;

a retainer comprising a platform with a connector opening and opposing retainer side walls;

a pump assembly secured to said retainer comprising an intake tube and an outlet tube connected to a nozzle having fluid outlet aperture, said intake tube and said outlet tube being in communication with a pump means for transporting the fluid from said receptacle to said outlet aperture;

a cover connected to said nozzle, said cover, nozzle and outlet tube being movable to cause actuation of said pump means; and a housing connected to said retainer for holding said receptacle, said housing and retainer having retention means for releasably attaching said housing to said retainer.

4. The fluid dispenser according to claim 3 wherein said retainer platform has opposing side areas and said retention means includes a flex arm extending downwardly from each one of said platform sides.

5. The fluid dispenser according to claim 3, wherein said platform has an underside and said receptacle has an outlet rim which sealingly engages said underside about the margin of said connector opening when said housing and retainer are attached.

6. A fluid dispenser comprising:

a housing having an interior with an open top;

a receptacle extending into said interior through said open top, said receptacle adapted to contain a fluid;

a retainer releasable secured to said housing and said receptacle, said retainer having a platform with a connector opening;

a pump assembly engaged with said connector opening, said pump assembly including a pump means with a fluid inlet;

a fluid outlet in communication with said pump means for moving said fluid from said receptacle into said fluid inlet and out of said fluid outlet;

said fluid outlet comprises a flow tube and said pump assembly includes a crown structure secured to said connector opening, said crown structure having a bore through which said flow tube extends; and said pump assembly includes a cover operably connected to said flow tube, said flow tube moving within said bore upon selected movement of said cover.

7. The dispenser of claim 6 wherein said pump means includes a biasing means for effecting a counter movement to said selected cover movement.

8. The dispenser of claim 6 wherein said pump assembly includes a nozzle having a fluid outlet aperture mounted upon said flow tube, said flow tube and fluid aperture being in fluid communication with each other.

9. The dispenser of claim 8 wherein said cover includes a nozzle enclosure which is engaged with said nozzle.

10. The dispenser of claim 6 wherein said retainer includes a rear wall upstanding from said platform having guide slots, said cover having tracks that move within said guide slots upon movement of said cover.

11. A fluid dispenser comprising:

a housing having an interior with an open top;

a receptacle extending into said interior through said open top, said receptacle adapted to contain a fluid;

a retainer releasable secured to said housing and said receptacle, said retainer having a platform with a connector opening;

a pump assembly engaged with said connector opening, said pump assembly including a pump means with a fluid inlet;

a fluid outlet in communication with said pump means for moving said fluid from said receptacle into said fluid inlet and out of said fluid outlet;

said housing includes retention parts and said retainer has opposing side areas with a flex arm extending downwardly from each opposing side area, each flex arm and a respective retention part comprise a retention means for releasably securing said retainer to said housing; and said receptacle has a top opening which is sealingly engaged to said platform connector opening when said receptacle is releasably secured to said housing.

12. A fluid dispenser comprising:

a housing having an interior with an open top;

a receptacle extending into said interior through said open top, said receptacle adapted to contain a fluid;

a retainer releasable secured to said housing and said receptacle, said retainer having a platform with a connector opening;

a pump assembly engaged with said connector opening, said pump assembly including a pump means with a fluid inlet;

a fluid outlet in communication with said pump means for moving said fluid from said receptacle into said fluid inlet and out of said fluid outlet;

said fluid outlet comprises a flow tube and said pump assembly includes a crown structure secured to said connector opening, said crown structure having a bore through which said flow tube extends;

said housing includes retention parts and said retainer has opposing side areas with a flex arm extending downwardly from each opposing side area, each flex arm and a respective retention part comprise a retention means for releasably securing said retainer to said housing; and said cover comprises a top wall with a peripheral skirt, said skirt having opposing side portions with each side portion having an inner lip element and wherein said retainer includes a retainer sidewall extending upwardly from said platform to a terminal end having a stop part that abuts with a corresponding lip element when said cover is in an uppermost inactive position.

* * * * *